United States Patent [19]

Higashiguchi

[11] 4,282,278

[45] Aug. 4, 1981

[54] TRANSFERABLE FLOCKED FIBER STICKER MATERIAL

[76] Inventor: Shigehiko Higashiguchi, 3-4-2 Honjo, Sumida-ku, Tokyo, Japan

[21] Appl. No.: 71,093

[22] Filed: Aug. 31, 1979

[51] Int. Cl.[3] ..... B05D 1/14

[52] U.S. Cl. ..... 428/90; 156/230; 156/279; 427/206; 428/914

[58] Field of Search ..... 428/90, 914; 427/200, 427/206; 156/279, 230

[56] References Cited

U.S. PATENT DOCUMENTS

| | | | |
|---|---|---|---|
| 3,326,824 | 6/1967 | Graham | 428/538 X |
| 3,379,604 | 4/1968 | Weber et al. | 428/914 X |
| 3,380,866 | 4/1968 | Ginter | 156/79 |
| 3,713,868 | 1/1973 | Gordon et al. | 428/314 X |
| 3,714,078 | 1/1973 | Gordon et al. | 428/314 X |
| 3,922,410 | 11/1975 | Halloran | 427/206 X |
| 4,035,532 | 7/1977 | Gregorian et al. | 427/206 X |
| 4,036,673 | 7/1977 | Murphy et al. | 428/95 X |
| 4,142,929 | 3/1979 | Otomine et al. | 428/90 X |
| 4,201,810 | 5/1980 | Higashiguchi | 427/206 X |

*Primary Examiner*—Henry F. Epstein

*Attorney, Agent, or Firm*—Pearne, Gordon, Sessions, McCoy & Granger

[57] ABSTRACT

A transferable flocked fiber sticker material comprising a base sheet, a release adhesive layer applied to one surface of the base sheet, fibers releasably flocked to the adhesive-applied surface of the base sheet in erect position and a hot melt resin adhesive mixture layer applied to the exposed ends of the fibers.

The hot melt resin adhesive mixture contains an inorganic or organic filler, a blowing agent and at least one rubber latex.

7 Claims, 1 Drawing Figure

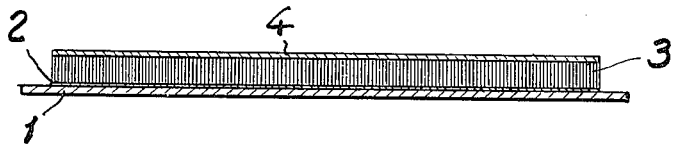
2
4
3
1

TRANSFERABLE FLOCKED FIBER STICKER MATERIAL

BACKGROUND OF THE INVENTION

This invention relates to an improved transferable flocked fiber sticker material.

There have been proposed and practically employed a great variety of transferable flocked fiber sticker materials and the transferable flocked fiber sticker materials of the prior art have been typically produced by the method which comprises the steps of applying a water soluble and water dispersible adhesive selected from the group consisting of carboxymethylcellulose (C.M.C.), casein, starch, rice-cake powder, acrylic acid resins and vinyl acetate resins to one surface of a base sheet which is formed of paper, cellophane or the like, releasably flocking a number of fibers to the adhesive-applied surface of the base sheet by electrostatic blowing and applying a thermoplastic synthetic resin adhesive to the exposed ends of all of the releasably flocked fibers or those of the flocked fibers in a desired design or pattern to form a thermoplastic resin adhesive layer thereon to thereby provide a transferable flocked fiber sticker material. In the transfer of the releasably flocked fibers from the thus produced transferable flocked fiber sticker material to a fabric such as a shirt, the sticker material is placed onto the fabric so as to bring the thermoplastic resin adhesive laver into contact with the fabric, heat and pressure are applied to the suface of the base sheet opposite from the release adhesive-applied surface thereof or to the surface of the fabric opposite from the surface thereof which is in contact with the thermoplastic resin adhesive layer so as to fuse the thermoplastic resin adhesive to the shirt to thereby cause the fibers to permanently adhere to the fabric, separating the transferable flocked fiber sticker material from the fabric after the curing of the thermoplastic resin adhesive so as to permanently transfer the fiber onto the fabric in the same pattern as that in which the thermoplastic resin adhesive was applied to the fibers.

The thermoplastic resin adhesive layer to be formed at the exposed ends of the releasably flocked fibers has been conventionally formed of at least one member selected from the group consisting of acrylic acid resins, latex resins, vinyl acetate resins and vinyl chloride resins, which layer serves to align the exposed ends of the fibers to which the thermoplastic resin has been applied and also hold hot melt resin adhesive which is sometime sprinkled over the thermoplastic resin layer on the latter. The thermoplastic resin adhesive is applied to the exposed ends of the releasably flocked fibers by the socalled screen printing, for example. When the hot melt resin adhesive which promotes adhesion of the fibers to a fabric such as a shirt is to be sprinkled over the thermoplastic resin adhesive layer, before the thermoplastic resin adhesive layer cures after the adhesive has been applied to the fabrics, the hot melt resin adhesive in the form of fine particles or pellets is sprinkled over the thermoplastic resin adhesive layer and the resultant assembly is forcibly dried by heating to render the hot melt resin adhesive to a partially fused state. The partially fused hot melt resin adhesive settles itself on the thermoplastic resin adhesive layer and then firmly adheres to the thermoplastic resin adhesive layer after the cooling of the assembly.

Thus, the process will not present any grave problem when the thermoplastic resin adhesive layer is formed to cover the exposed ends of all the releasably flocked fibers. On the other hand, when the thermoplastic resin adhesive is applied to the exposed ends of selected ones of the releasably flocked fibers in a design or pattern, first of all, the thermoplastic resin adhesive is applied to the exposed ends of the selected fibers by the screen printing or the like and the hot melt resin adhesive in fine particle or pellet form is sprinkled over the thermoplastic resin adhesive layer before the latter dries. However, in the sprinkling of the hot melt resin adhesive, a portion of the sprinkled hot melt resin adhesive particles frequently fall onto the exposed ends of the fibers which are not covered by the thermoplastic resin adhesive layer applied in the design or pattern and/or fall into the spaces between the fibers. If the assembly is dried by heating with the hot melt resin adhesive particles remaining on the fibers not covered by the design or pattern and in the spaces between the fibers, such portion of the hot melt resin adhesive particles soften to the degree that the hot melt resin adhesive particles cause the releasably flocked fibers to adhere to each other to form a fiber mass and/or the hot melt resin adhesive particles themselves adhered to the fibers not covered by the design to provide an unsatisfactory transferable flocked fiber sticker material. Thus, when the releasably flocked fibers are transferred from such an unsatisfactory sticker material onto a fabric, the fibers cannot be transferred onto the fabric in the desired or intended design or pattern. Therefore, such hot melt resin adhesive particles have to be removed from the fibers not covered by the design and/or the spaces between the fibers before the obtained transferable flocked fiber sticker material is subjected to the drying step. However, it is very difficult or tedious to remove the hot melt resin adhesive particles from the spaces between the fibers resulting in diminishing of the production efficiency of the transferable flocked fiber sticker material.

SUMMARY OF THE INVENTION

Therefore, the present invention is to provide a novel and improved transferable flocked fiber sticker material by the above-mentioned conventional method except for the elimination of the hot melt resin adhesive sprinkling step therefrom so as to evade the disadvantage that the hot melt resin adhesive particles adhere to any undesired area of the fiber flocked surface of the obtained transferable flocked fiber sticker material.

As a result of the elimination of the hot melt resin adhesive particle sprinkling step in the production of a transferable flocked fiber sticker material according to the present invention, the production efficiency of the sticker material is greatly enhanced.

The above and other objects and attendant advantages of the present invention will be more readily apparent to those skilled in the art from a reading of the following detailed description in conjunction with the accompanying drawing which shows one preferred embodiment of the invention for illustration purpose only, but not for limiting the scope of the same in any way.

BRIEF DESCRIPTION OF THE FIGURE

The sole FIGURE of the accompanying drawing is a vertically sectional view on an exaggerated scale of the transferable flocked fiber sticker material embodying the present invention.

PREFERRED EMBODIMENT OF THE INVENTION

The present invention will be now described referring to the accompanying drawing.

The applicant has already proposed a transferable flocked fiber sticker material and the transferable flocked fiber sticker material is produced by the method which comprises the steps of applying a release adhesive to one surface of a base sheet formed of paper, cellophane, cloth or non-woven fabric, releasably flocking fibers to the adhesive-applied surface of the base sheet by electrostatic blasting, applying a hot melt resin adhesive in the form of a paste dissolved in water or other liquid solvent to the fiber-flocked surface of the base sheet by screen printing or the like, heating the thus obtained assembly to a temperature just sufficient to evaporate the water or other liquid solvent and render the hot melt resin adhesive to a partially fused state to thereby cause the hot melt resin adhesive to adhere to the fiber-flocked surface of the base sheet and cooling the assembly so as to firmly hold the hot melt resin adhesive on the fiber-flocked surface of the base sheet.

However, although the transferable flocked fiber sticker material produced by the production steps described just above is advantageous over the comparable prior products, since the hot melt resin adhesive is directly applied to the fiber-flocked surface of the base sheet, when the releasably flocked fibers are transferred from the transferable flocked fiber sticker material onto a fabric such as a shirt by applying the sticker material against the fabric so as to bring the hot melt resin adhesive layer into contact with the fabric and then applying heat and pressure to the sticker material or fabric to fuse the hot melt resin adhesive, since the hot melt resin adhesive is directly applied to the fiber-flocked surface of the base sheet in the sticker material and the sticker material lacks any intervening material between the fabric and flocked fibers which corresponds to the thermoplastic resin adhesive layer applied to the exposed ends of the releasably flocked fibers and principally acting to hold the fiber ends in line as found in the transferable flocked fiber sticker material described in the preamble of this application, there are the disadvantages that the transferred fibers lack any appreciable three-dimensional appearance and when the fabric having the fibers transferred thereon is folded, a crack or cracks would develop in the hot melt resin adhesive layer which firmly holds the transferred fibers on the fabric.

In order to produce a transferable flocked fiber sticker material which eliminates the disadvantages such as lack of three-dimensional appearance and cracks in the hot melt resin layer, the applicant has conducted various experiments resulting in the present invention.

According to the present invention, one surface of a base sheet 1 formed of paper, cellophane or cloth as employed in the previously proposed transferable flocked fiber sticker materials has applied thereto an adhesive capable of releasably flocking fibers to the base sheet to form a release adhesive layer 2, fibers 3 are releasably flocked to the adhesive-applied surface of the base sheet 1 in erect and closely adjacent relationship and a hot melt resin adhesive mixture is applied to the exposed ends of the releasably flocked fibers 3 to form a transfer adhesive layer 4. In the preparation of the adhesive mixture forming the transfer adhesive layer 4, a hot melt resin adhesive in the form of fine particles has added thereto at least one elasticity imparting assistant selected from the group consisting of styrene butadiene rubber latex, vinyl pyridine latex, isoprene rubber latex, chloroprene rubber latex, acrylate latex and butyl rubber latex (these elasticity imparting assistants serve to prevent the development of a crack or cracks in the transfer adhesive layer 4 when the fabric having the fibers 3 transferred thereon is folded), at least one inorganic or organic filler selected from the group consisting of clay, silicates, calcium sulfate, calcium carbonate and magnesium carbonate, for example, which have been generally employed as bulk fillers and if necessary or desired, a blowing agent, and the resultant hot melt resin adhesive mixture is dissolved in water or other liquid solvent to provide a paste form hot melt resin adhesive mixture. The paste form hot melt resin adhesive mixture is applied to the exposed ends of the fibers 3 releasably flocked to the base sheet 1 in the manner mentioned hereinabove and the fibers are then transferred from the thus obtained transferable flocked fiber sticker material onto a fabric such as a shirt in the manner mentioned hereinabove.

In the fiber transfer operation, the applied heat and pressure fuse the paste form hot melt resin adhesive and the additives in the fused hot melt resin adhesive mixture exhibit their respectively expected functions and thus, the fibers transferred onto the fabric in a design or pattern give a three-dimensional appearance and even when the fabric having the fibers transferred thereon is folded, no crack develops in the hot melt resin adhesive layer whereby a transferred fiber design having a clear-cut configuration can be obtained.

As to the fine particle hot melt resin adhesive referred to hereinabove, the adhesive itself has been sold by Nippon Rirusan Co., Ltd. under the trade name "Platamid H-105P-80.H-105PS-80.H-005P-80" and by Sumitomo Chemical Industry Co., Ltd. under the trade name "Sumilink DR-55 grade S,DR-150 grade S" and the fine particle hot melt resin adhesive having a plasticizer as a molding assistant added thereto has been sold by Toyo Rayon Co., Ltd. under the trade name "832-P80, 833-P80". When the latter is employed, the elasticity imparting assistant, bulk filler and and blowing agent referred to hereinabove are added to the hot melt resin adhesive in suitable amounts by taking the amount of the plasticizer into consideration. The thus prepared hot melt resin adhesive mixture is dissolved in water or other liquid solvent to provide a paste form hot melt resin adhesive mixture and the paste is applied to the exposed ends of the fibers releasably flocked to the base sheet.

While only one embodiment of the invention has been shown and described in detail, it will be understood that the same is for illustration purpose only and not to be taken as a definition of the invention, reference being had for this purpose to the appended claims.

What is claimed is:

1. A transferable flocked fiber sticker material formed of a base sheet selected from the group consisting of paper, cellophane, cloth and non-woven fabric, a release adhesive layer applied to one surface of said base sheet, fibers releasably flocked to said adhesive-applied surface of the base sheet, a hot melt resin adhesive mixture layer applied as a paste to the exposed ends of said releasably flocked fibers and said hot melt resin adhesive mixture containing at least one elasticity imparting agent.

2. The transferable flocked fiber sticker material as set forth in claim 1, in which said hot melt resin adhesive mixture further contains at least one bulk filler.

3. The transferable flocked fiber sticker material as set forth in claim 1, in which said hot metal resin adhesive mixture further contains a blowing agent.

4. The transferable flocked fiber sticker material as set forth in claim 1, in which said elasticity imparting agent comprises at least one member selected from the group consisting of styrene butadiene rubber latex, vinyl pyridine latex, isoprene rubber latex, chloroprene latex, acrylate latex and butyl rubber latex.

5. The transferable flocked fiber sticker material as set forth in claim 2, in which said bulk filler comprises at least one member selected from the group consisting of clay, silicates, calcium sulfate, calcium carbonate and magnesium carbonate.

6. The method of making a transferable flocked fiber sticker material comprising the steps of, selecting a base from the group consisting of paper, cellophane, cloth and non-woven fabric, applying a release adhesive layer to one surface of said base sheet, releasably flocking a plurality of fiber flock material to said adhesive layer, and applying a hot melt resin adhesive mixture containing at least one elasticity imparting agent to said flock material in the form of a paste dissolved in water or other liquid solvent.

7. The method as set forth in claim 6 in which said hot melt resin adhesive mixture layer is formed by applying said paste of hot melt resin adhesive mixture to the exposed surface of the releasably flocked material, heating the assembly including said base sheet, release adhesive layer, releasably flocked material and hot melt resin adhesive mixture layer to a temperature just sufficient to evaporate said solvent and render said hot melt resin adhesive mixture to a partially fused state.

* * * * *